US005727898A

United States Patent [19]

Lu

[11] Patent Number: 5,727,898

[45] Date of Patent: Mar. 17, 1998

[54] LOCATING STRUCTURE FOR LUGGAGE PULL ROD

[76] Inventor: Lien-Ching Lu, No.12, Tien-Hsin Li, Yuan Li Chen, Miao-Li Hsien, Taiwan

[21] Appl. No.: 725,092

[22] Filed: Oct. 2, 1996

[51] Int. Cl.[6] ..... B25G 1/04; A45C 13/22

[52] U.S. Cl. ..... 403/325; 403/109; 16/115; 280/655; 190/115

[58] Field of Search ..... 403/325, 109, 403/104, 326; 190/115, 117; 16/110 R, 115; 280/655, 655.1, 47.315

[56] References Cited

U.S. PATENT DOCUMENTS

| | | | |
|---|---|---|---|
| 4,974,871 | 12/1990 | Mao | 16/115 X |
| 5,458,020 | 10/1995 | Wang | 403/325 X |
| 5,459,908 | 10/1995 | Chen | 16/115 |
| 5,499,426 | 3/1996 | Hsieh | 16/115 |
| 5,584,097 | 12/1996 | Lu | 16/115 |

*Primary Examiner*—Anthony Knight
*Attorney, Agent, or Firm*—Bacon & Thomas

[57] ABSTRACT

A locating structure for luggage pull rod including a handle, a transmission assembly, a linking lever, an inner tube, a hollow inner engaging tube secured at the bottom end and an outer tube. A lateral side of the inner engaging tube is formed with a through hole. The upper and lower edges of the through hole are respectively disposed with two restricting blocks. The other lateral side is open and engaged with an engaging cover. A slide seat is fitted in the inner engaging tube and formed with an inner cavity. The slide seat is up and down movably fitted with the restricting blocks. Two inclined channels are formed near the belly of the cavity, so that the guide posts of the locating block are inserted in the inclined channels of the slide seat. The locating block has a locating button at the front end. The locating button is passed and engaged in the through hole of the inner engaging tube. A rear end of the locating block is disposed with a fitting block fitted and restricted in the cavity of the slide seat. A spring is fitted in the interior of the slide seat and the inner engaging tube. When the transmission assembly is forced downward, the transmission plate is depressed and the linking lever is also depressed to move the slide seat downward. The inclined channels cooperate with the guide posts to retract and disengage the locating block from the locating hole of the outer tube, so that the pull rod can be pulled upward or pushed downward.

1 Claim, 5 Drawing Sheets

LOCATING STRUCTURE FOR LUGGAGE PULL ROD

BACKGROUND OF THE INVENTION

The present invention relates to a locating structure for luggage pull rod, which is evenly forced to accurately locate the luggage pull rod.

FIG. 1 shows a conventional luggage pull rod structure in which a controlling depression board 11 is disposed on the handle 1 and a linking means is disposed therein. Two inner tubes 2 are passed through two ends of the handle 1. The upper end of each inner tube 2 is disposed with a pad member 22. A linking lever 21 is disposed in the inner tube. The linking lever 21 extends from the handle 1 through the inner tube to the inner engaging tube 3. The inner engaging tube 3 is secured at the lower end of the inner tube 2. The wall of the inner engaging tube 3 is formed with an inner hole 31 in which an engaging block 33 and a push block 34 are disposed in the inner hole 31. The push block 34 is connected to the lower end of the linking lever 3. A bottom pad 35 is fitted with the bottom end and an engaging pad 36 is used to seal the bottom end. The engaging pad 36 is disposed with engaging hooks 361 for hooking in the hook holes 32 of the inner engaging tube 3. The inner tube 2 is disposed in the outer tube 4. The wall of the outer tube 4 is formed with several engaging holes 41.

When adjusting the length of the pull rod, the handle 1 is held to depress the controlling depression board 11 to drivingly depress the linking lever 21 and make the push block 33 move downward. At this time, the engaging block 34 is pushed by the push block 33 and retracted into the inner tube 2, whereby the length of the pull rod can be adjusted as shown in FIG. 2. When fixing the pull rod, the controlling depression board 11 is released and the linking lever 21 is bounded by the spring to its home position. The engaging block 33 is restored to its home position and located in the engaging hole 41 of the outer tube 4. Although the above structure can achieve a locating effect, after a long period of use, several shortcomings exist as follows:

1. When the controlling depression board 11 is depressed, the linking lever 21 is also moved downward. The push block 33 abuts against the engaging block 34. However, the lower end of the engaging block 34 is formed with a notch 341 fitted with a spring 342 so that when the linking lever 21 exerts a force on the engaging block 34, the gravity center of the engaging block 34 is unstable and will be upward tilted as shown by the phantom line of FIG. 3. Therefore, the front end of the engaging block 34 will be lifted to engage with the engaging hole 41 of the outer tube 4. This prevents the pull rod from being smoothly pulled upward or pushed downward.

2. The lower end of the linking lever 21 is connected with the push block 33 by screwing. After a long period of use of the pull rod, the linking lever 21 is moved up and down many times and tends to rotate. (The top end of the linking lever abuts against the controlling depression board 11 and cannot be accurately located.) Therefore, the linking lever 21 is apt to detach from the push block 33 and loses its locating function.

SUMMARY OF THE INVENTION

It is therefore a primary object of the present invention to provide a locating structure for luggage pull rod, which is evenly forced to accurately locate the luggage pull rod without detachment.

The present invention can be best understood through the following description and accompanying drawings, wherein:

DETAILED DESCRIPTION OF THE PREFERRED EMBODIMENT

Figure 1:
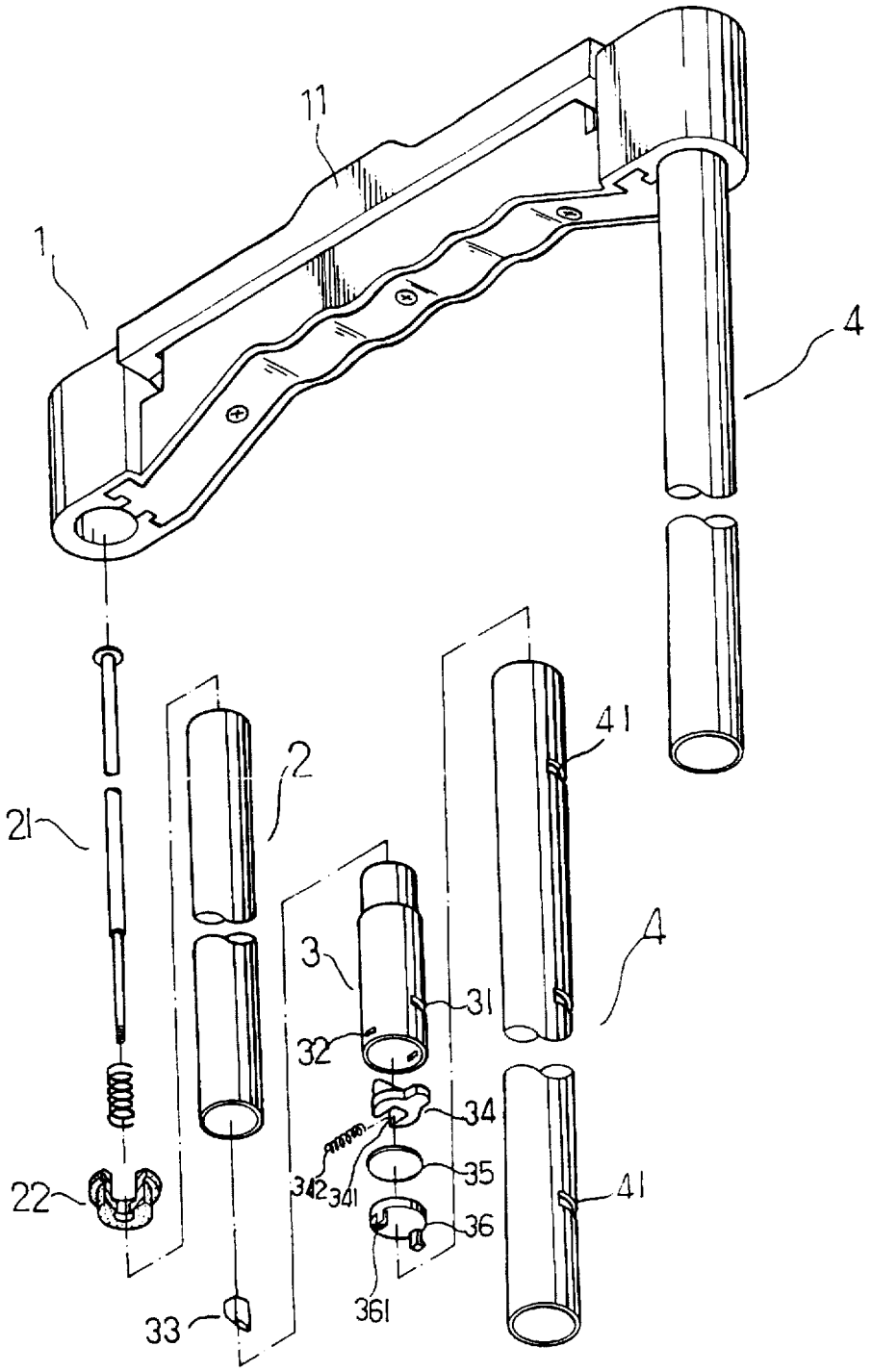
FIG. 1 PRIOR ART
FIG. 1 is a perspective exploded view of a conventional luggage pull rod structure.
Figure 3:
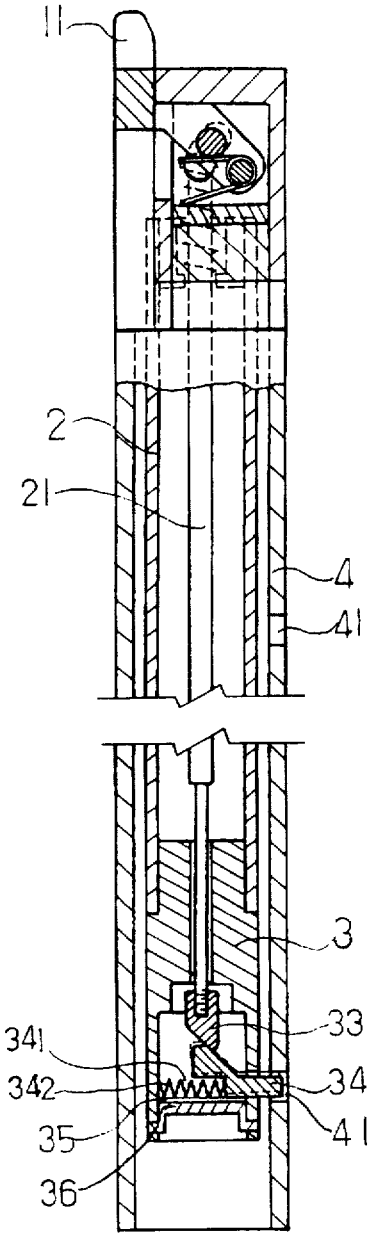
FIG. 3 PRIOR ART
FIG. 3 is a sectional view showing the conventional luggage pull rod structure in a located state.
Figure 2:
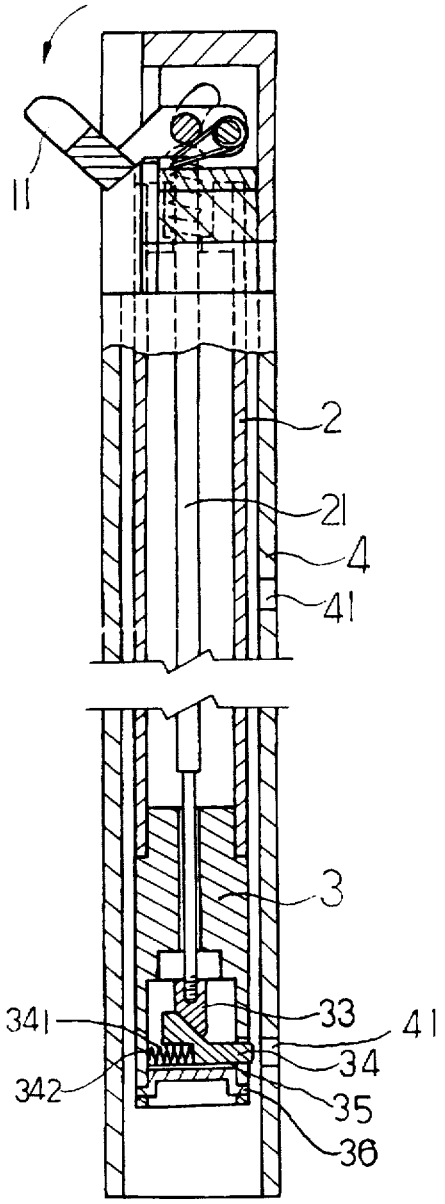
FIG. 2 PRIOR ART
FIG. 2 is a sectional view showing the conventional luggage pull rod structure in an adjusted state.
Figure 4:
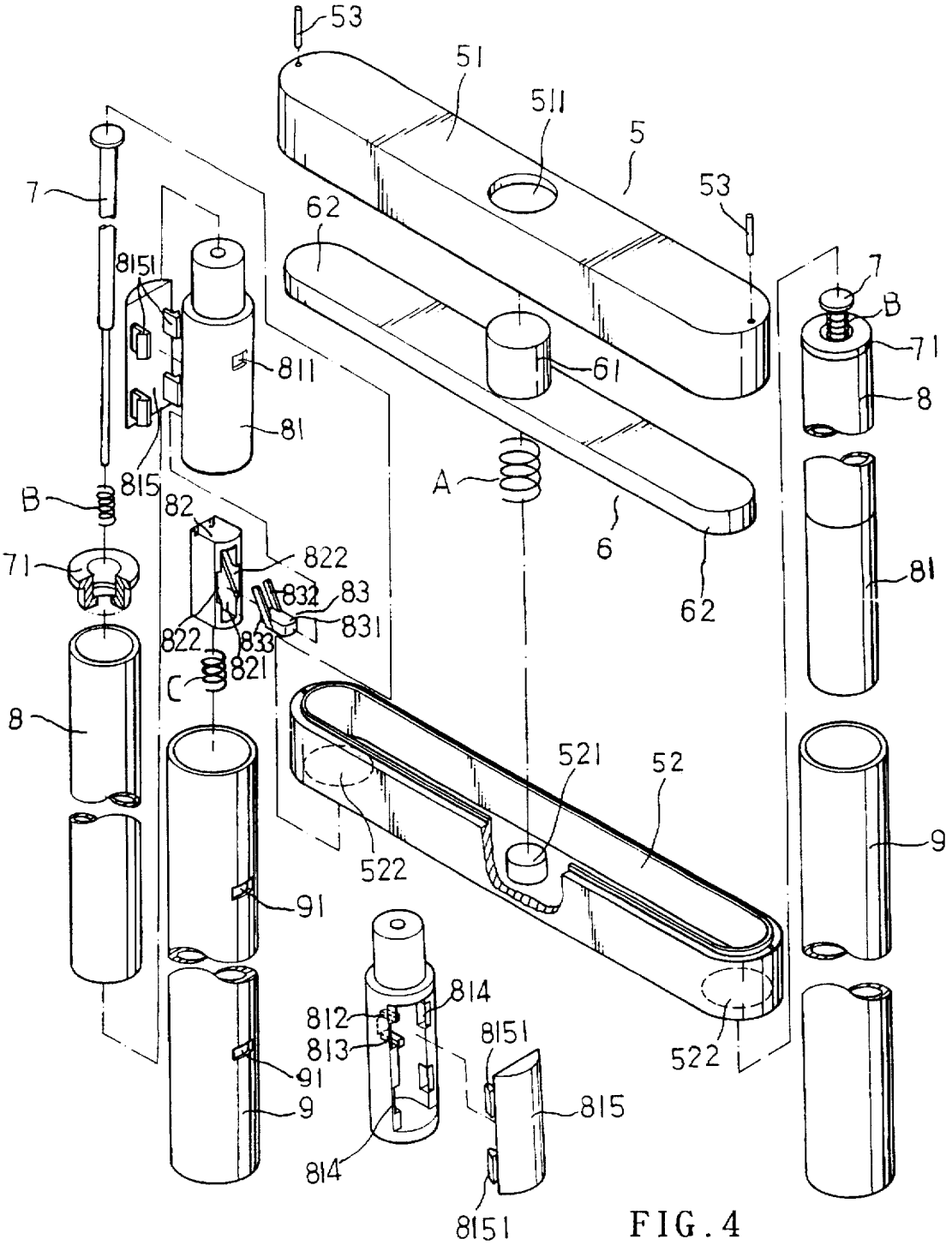
FIG. 4 is a perspective exploded view of the present invention.

Please refer to FIG. 4. The present invention mainly includes a handle 5, a transmission assembly 6, a linking lever 7, an inner tube 8 and an outer tube 9. The handle 5 is composed of an upper and a lower cover bodies 51, 52 associated with each other by rivets 53. The upper face of the upper cover 51 is formed with a through hole 511 for a control button 61 of the transmission assembly 6 to fit therein. The control button 61 has an inner chamber for receiving a spring A. The other end of the spring A is fixed on a boss 521 in the lower cover body 52.

The inner tube 8 is fitted in the outer tube 9. The upper end of the inner tube is fitted in the through hole 522 of the lower cover body 52. The linking lever 7 is passed into the inner tube 8. The top end of the linking lever 7 abuts against the transmission plate 62 of the transmission assembly 6. A washer 71 is disposed at the upper ends of the linking lever 7 and the inner tube 8. A spring B is disposed in the washer 71.

A hollow inner engaging tube 81 is secured at the bottom end of the inner tube 8. A lateral side of the inner engaging tube 81 is formed with a through hole 811 for a locating block 83 to pass therethrough. The upper and lower edges of the through hole 811 are respectively disposed with two restricting blocks 812, 813. The other lateral side of the inner engaging tube 81 is open with the inner wall formed with engaging recesses 814 for the engaging blocks 8151 of the engaging cover 815 to engage therewith.

A slide seat 82 is fitted in the inner engaging tube 81 and formed with an inner cavity 821 having a length larger than the upper and lower restricting blocks 812, 813 of the inner engaging tube 81, whereby the slide seat 82 is up and down movable in the inner engaging tube 81. Two inclined channels 822 are formed near the belly of the cavity 821 from lower side to upper side.

A locating block 83 having a main body and a locating button 831 formed at the front end thereof and passed in the through hole 811 of the inner engaging tube. Near the center of the main body are formed upward extending inclined guide posts 832 corresponding to the inclined channels 822. The rear end of the main body is disposed with a fitting block 833.

A spring C is fitted in the inner engaging tube 81 and positioned at lower end of the slide seat 82.

Figure 5:
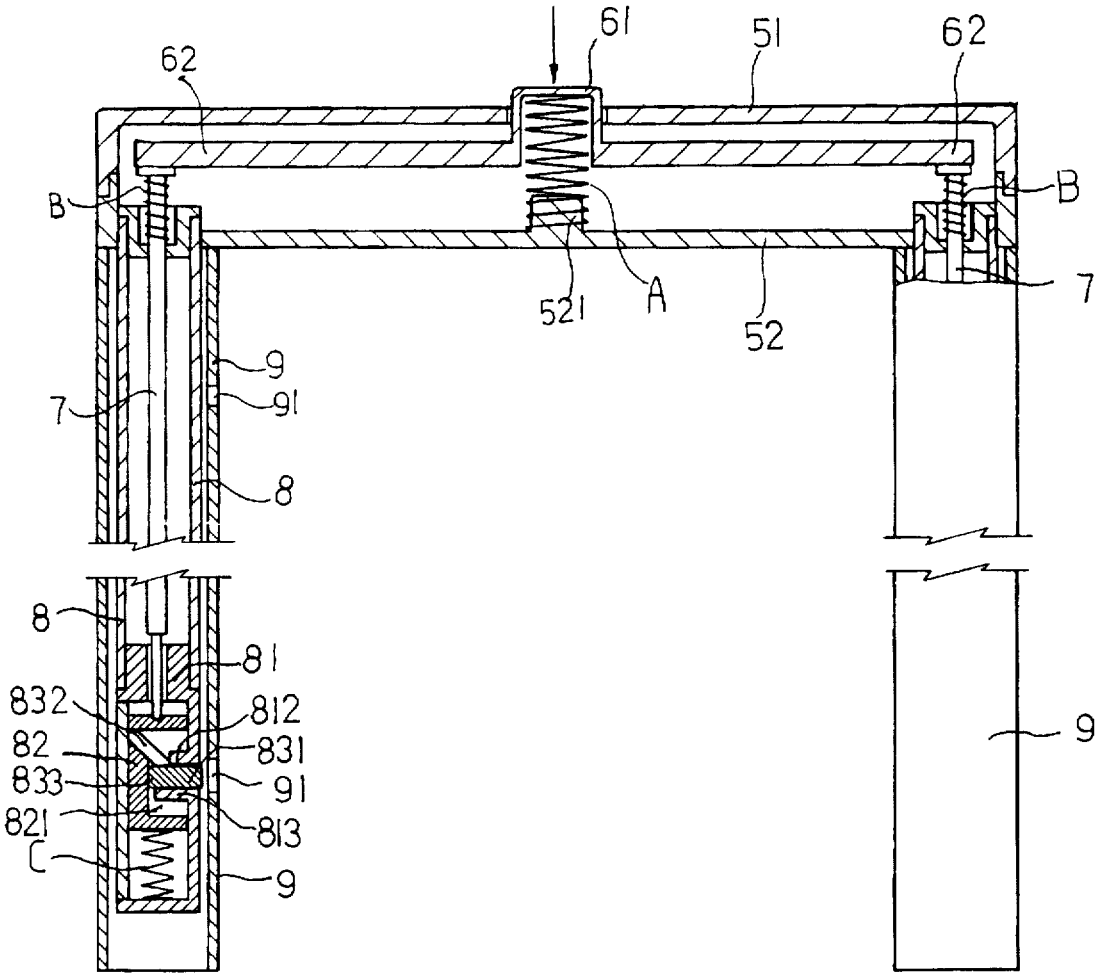
FIG. 5 is a sectional view showing the present luggage pull rod structure in an adjusted state.

According to the above arrangement, referring to FIG. 5, when the transmission assembly 6 is forced, the transmission plate is depressed and the linking lever 7 is also depressed along with the transmission plate to touch the slide seat 82 in the inner engaging tube 81. That is, the slide seat 82 is also moved downward. At this time, because the guide posts 832 of the locating block 83 are inserted in the inclined channels 822 of the slide seat 82, the locating block 83 is depressed along with the slide seat 82. However, the locating button 831 of the locating block 83 is fitted in the through hole 811 of the inner engaging tube 81 and restricted by the upper and lower restricting blocks 812, 813, so that when the slide seat 82 is depressed, by means of the cooperation of the inclined channels 822 with the guide posts 832, the locating block 83 is retracted inward to make the locating block 83 disengaged from the locating hole 91 of the outer tube 9, whereby the pull rod can be pulled upward or pushed downward.

Figure 6:
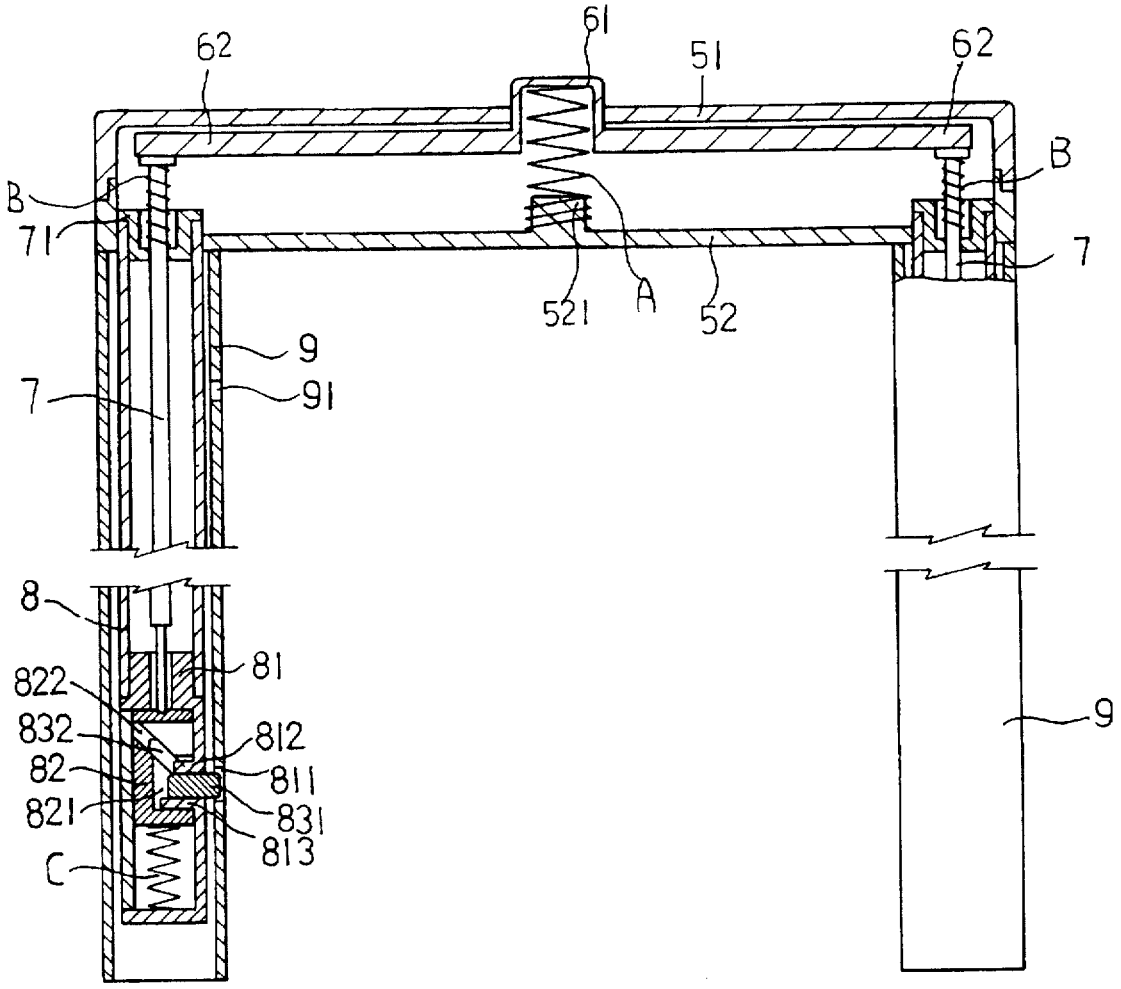
FIG. 6 is a sectional view showing the present luggage pull rod structure in a located state.

Reversely, referring to FIG. 6, when the external force disappears, the transmission assembly 6 is restored to its home position by the spring A. At this time, the slide seat 82 is also upward restored to its home position by the spring C. Simultaneously, the inclined channels 822 of the slide seat 82 are moved upward, the guide posts 832 of the locating block 83 make the locating block 83 pushed forward to be engaged with and located in the locating hole 91 of the outer tube 9.

The above embodiment is only an example of the present invention and the scope of the present invention should not be limited to the example. Any modification or variation derived from the example should fall within the scope of the present invention.

What is claimed is:

1. A locating structure for a luggage pull rod, comprising a handle, a transmission assembly, a linking lever, a hollow inner engaging tube, an inner tube and an outer tube, the inner engaging tube being secured at the bottom end of the inner tube, said luggage pull rod structure being characterized in that a lateral side of the inner engaging tube is formed with a through hole, the upper and lower edges of the through hole being respectively disposed with two restricting blocks, the other lateral side of the inner engaging tube being open and engaged with an engaging cover, a slide seat being fitted in the inner engaging tube and formed with an inner cavity, whereby the slide seat is up and down movably fitted with the restricting blocks, two inclined channels being formed near the belly of the cavity from lower side to upper side, whereby the guide posts of the locating block are inserted in the inclined channels of the slide seat, the locating block having a locating button in front of the guide posts, the locating button being passed and engaged in the through hole of the inner engaging tube, a rear end of the locating block being disposed with a fitting block fitted and restricted in the cavity of the slide seat, a spring being fitted in the interior of the slide seat and the inner engaging tube.

* * * * *